United States Patent [19]

Matricon et al.

[11] Patent Number: 4,912,956

[45] Date of Patent: Apr. 3, 1990

[54] PROCESS AND APPARATUS FOR ROLLING A METAL SHEET OR STRIP

[75] Inventors: Paul Matricon, La Garenne Colombes; Marc Valence, Courbevoie, both of France

[73] Assignee: CLECIM, Courbevoie, France

[21] Appl. No.: 179,948

[22] Filed: Apr. 11, 1988

[30] Foreign Application Priority Data

Apr. 9, 1987 [FR] France ..... 87 05031

[51] Int. Cl.[4] ..... B71B 31/16

[52] U.S. Cl. ..... 72/243; 72/16; 72/245

[58] Field of Search ..... 72/241, 243, 245, 8–12, 72/16

[56] References Cited

U.S. PATENT DOCUMENTS

| | | | |
|---|---|---|---|
| 4,480,452 | 11/1984 | Schnyder | 72/243 |
| 4,480,459 | 11/1984 | Feldman et al. | 72/243 |
| 4,587,819 | 5/1986 | Hausen | 72/17 |
| 4,611,479 | 9/1986 | Guttinger | 72/243 |
| 4,633,693 | 1/1987 | Tahara et al. | 72/17 |
| 4,651,547 | 3/1987 | Moul et al. | 72/243 |
| 4,676,085 | 6/1987 | Ellis | 72/243 |
| 4,711,116 | 12/1987 | Bald | 72/243 |
| 4,770,021 | 9/1988 | Kobayashi et al. | 72/243 |
| 4,813,259 | 3/1989 | Grocock et al. | 72/243 |

*Primary Examiner*—P. W. Echols
*Assistant Examiner*—Irene Cuda
*Attorney, Agent, or Firm*—Pollock, Vande Sande & Priddy

[57] ABSTRACT

A process and apparatus for rolling a metal product (5) in a "four-high" type rolling mill comprising two work rolls (1) and (2) interposed between two backup rolls (3) (4) at least one of which is of the variable camber type having a cylindrical casing (33) mounted on a central shaft (31), the profile of the casing (33) being adjustable. The other backup roll (4) is a simple solid coacting roll whicl deforms freely under the action of the pressure load to form a line of support (47) which is concave in the direction of the roll pass (50). The deformation of the casing (33) of the variable camber backup roll (3) is controlled so as to form a line of support (37) which is convex in the direction of the roll pass (50) and substantially parallel to the line of support (47) of the coacting roll (4), and the camber of the work roll (1) is adjusted so as to maintain a constant thickness of the roll pass over the entire width of the product (5), the latter on leaving the rolling mill having an incurved transverse profile capable of being subsequently corrected.

9 Claims, 4 Drawing Sheets

PROCESS AND APPARATUS FOR ROLLING A METAL SHEET OR STRIP

FIELD OF THE INVENTION

The invention relates to a process and apparatus for rolling metal products, such as sheets or strips.

BACKGROUND OF THE INVENTION

For the purpose of rolling metal products in band form, use is made of rolling mill trains, each of which consists of a stand comprising two spaced support columns which are connected by crosspieces and between which is mounted an assembly of superposed rolls whose axes are parallel and which are disposed in the same plane. Each roll is mounted for rotation about a shaft carried at its two ends by support means housed respectively in the two columns of the stand.

Different types of rolling mills can be made. Rolling mills known as "four-high" comprise four rolls, namely two work rolls, between which the rolled product passes and which are each supported, on the side opposite the product, on a backup roll. Other arrangements can also be envisaged, for example the passing of the band between a work roll and a coacting roll supported on the stand, its work roll being applied, on the opposite side, against a backup roll to which the pressure load is applied. Rolls of the "six-up" type, on the other hand, include intermediate rolls interposed between the backup rolls and the work rolls.

The rolls bear against one another along substantially parallel support lines directed along a generatrix whose normally rectilinear profile depends on the loads applied and the resistance of the roll. The pressure load is generally applied by screws or jacks interposed between the stand and the ends of the top backup roll shaft, while the bottom backup roll or coacting roll is supported directly on the stand. Apart from the last-mentioned roll, the other rolls must therefore be able to move slightly relative to the stand, and they are therefore carried by support means mounted for vertical sliding movement inside the corresponding columns of the stand.

In view of the fact that the pressure load is applied to the two ends of the top backup roll and that the rolled product, of variable width, does not cover the entire length of the work rolls, each roll can sag through the action of the loads applied, and this results in a variation of the thickness of the space for the passage of the band between the work rolls, so that the edges of the band may be thinner than the central portion.

For a long time, attempts have been made to correct these defects in thickness on the profile across the rolled product, and different means are employed for this purpose.

In particular, it has been proposed to utilize backup rolls having a slightly cambered external profile adapted to compensate for the sagging of the roll through the action of the pressure load, so that the generatrix of contact with the corresponding work roll will be substantially rectilinear. However, this profile can be determined only in dependence on an average rolling load.

Correction facilities are improved by using variable camber rolls comprising a central shaft on which is mounted a deformable cylindrical casing whose profile can be determined by applying thrust loads between the shaft and the casing in order to compensate for the sagging of the shaft in dependence on the rolling load.

In one known arrangement, the central shaft, which is mounted for rotation about its axis, is provided on its periphery with a space formed on the outside by the deformable casing, the latter being sealingly connected to the shaft in such a manner as to form a closed annular space into which a fluid under adjustable pressure is introduced.

By inflating the casing, it is thus possible to vary its profile.

In another known arrangement, which is used in particular in the paper industry, the peripheral wall of the backup roll consists of a tubular casing mounted for rotation about two bearings on the central shaft, the latter being secured against rotation and forming a support beam on which are supported a plurality of casing carrier shoes distributed along a generatrix of support and extending radially between the support beam and the inner face of the casing, with the interposition of a lubricant film permitting the rotation of the casing. Each shoe bears on the support beam with the aid of at least one jack allowing individual adjustment of the radial position of the shoe in dependence on the profile to be given to the line of support in order to correct defects in the thickness and flatness of the band, measured downstream of the rolling mill by known devices. The corrections can thus be distributed over the width of the band in such a manner as to achieve rapid correction of localized thickness or flatness defects.

Since the aim of the rolling operation is to obtain products whose thickness is as constant as possible, it is logical to use symmetrical installations comprising on each side of the product a variable camber roll whose profile is adjusted to compensate for the sagging of the shaft, in such a manner that the line of support on the corresponding work roll will be as rectilinear as possible. However, complete compensation for this sag cannot always be achieved, and in addition the work rolls, which are generally of small diameter, may tend to ovalize through the action of the loads applied. For that reason it has also already been proposed to supplement the correction of the profile of the backup rolls, achieved through a cambering action of the work rolls, by applying bending loads to the ends of the shaft of each roll.

Each work roll is in fact carried at its ends by bearings housed in chocks mounted for sliding in the corresponding columns of the stand, the relative positioning of which chocks can be adjusted by means of hydraulic jacks applying thrust loads in opposite directions to lugs fastened to each chock. A so-called "positive" camber can thus be achieved by reducing the space between the chocks of the two work rolls in order to compensate for increased thickness of the edges of the product, or a so-called "negative" camber can be obtained by moving apart the chocks of the two work rolls to compensate for increased thickness of the central portion of the product.

The invention is therefore particularly, though not exclusively, applicable to a rolling mill of the four-high type comprising, inside a support stand, four rolls having parallel axes and superposed along a roll adjustment plane, each mounted for rotation about a shaft carried at its two ends by support means housed in the columns of the stand, i.e., two work rolls forming between them an elongate space for the passage of the product and each bearing on the opposite side against a backup roll, at least one of which backup rolls is of the variable camber type comprising a cylindrical casing mounted for rotation on a central shaft, and means for adjusting the profile of the casing through the application of thrust loads between the central shaft and the inner wall of the casing, the pressure load being applied to the ends of the backup roll shaft and the work rolls being associated with cambering means applying bending loads to the ends of their shafts.

For the purpose of checking the flatness and uniformity of thickness of the rolled product under the best possible conditions, it has previously been considered normal to make use of symmetrical installations comprising in particular two variable camber backup rolls. However, arrangements of this kind are expensive and make use of delicate components liable to deteriorate, so that the cost of production and operation of the rolling mill is substantially increased.

SUMMARY OF THE INVENTION

The invention relates to a process making it possible to achieve in optimum manner the correction of defects in the thickness and flatness of the product and being utilizable in a simpler and less expensive installation, each rolling mill stand being in fact equipped with a single variable camber backup roll, while the other backup roll is a solid coacting roll supported directly on the stand by the ends of the shaft on which it rotates.

According to the invention, the solid coacting roll is allowed to deform freely through the action of the pressure load, forming a line of support which is concave in the direction of the product, the deformation of the casing of the variable camber backup roll is controlled in such a manner as to form a line of support which is convex in the direction of the product and substantially parallel to the line of support of the coacting roll, and the camber of each work roll is adjusted individually to maintain a constant thickness of the roll pass over the entire width of the product, so that on leaving the stand the product will have an incurved transverse profile which is subsequently straightened by known means.

According to one feature of the invention, the camber of the work rolls is adjusted by subjecting the ends of their shafts to bending loads whose direction and intensity are individually adjustable for each end of each roll bearing directly on the corresponding column of the stand.

The camber of the two work rolls is preferably achieved by applying thrust loads in one direction or the other to the means supporting their shafts, and the position of each support means of each work roll is adjusted separately to maintain a constant thickness of the roll pass. For this purpose, when the work roll support means are in the form of chocks mounted for sliding along the corresponding columns of the stand and acted on by cambering jacks, independent of one another and corresponding respectively to each chock of each work roll, each group of jacks bearing directly on the corresponding column of the stand and being associated with a separate control means for the individual adjustment of the cambering load applied to each end of each roll.

According to another feature of the invention, the adjustment of the external profile of the backup roll and of the camber of the work rolls is effected automatically by reference to a model taking into account the dimensional and resistance characteristics of the different components and of the product, and adapted to determine the corrections to be made to the profile of the deformable casing and to the position of each support means, based on measurements of thickness and flatness made on the band downstream of the rolling mill, in such a manner as to maintain a constant thickness of the roll pass over the entire width of the band.

To this end, according to another feature of the invention, the shape of the line of support of each work roll on the product is determined on the basis of measurements made downstream and in dependence on the loads applied, and the corrections to be made to the profile of the backup roll and to the camber of the work rolls are determined by comparing the profiles of the lines of support in order to keep them parallel to one another and spaced apart a constant distance corresponding to the thickness to be given to the product.

BRIEF DESCRIPTION OF THE DRAWINGS

The invention will be better understood from the detailed description of a particular embodiment, which is given by way of example and illustrated in the accompanying drawings.

DESCRIPTION OF PREFERRED EMBODIMENT

Figure 1:
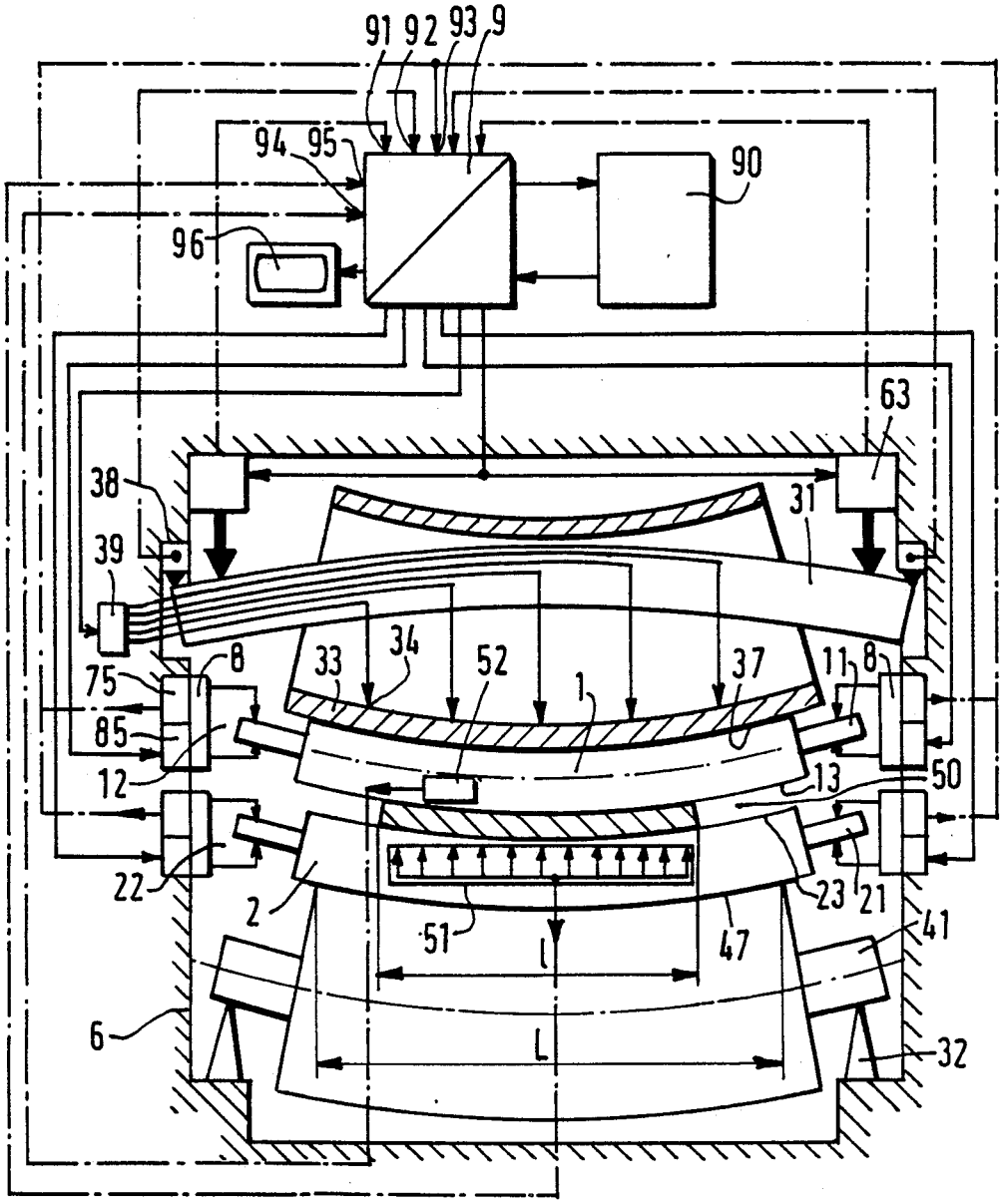
FIG. 1 is a general schematic view of the rolling mill stand and of its adjustment system.
Figure 2:
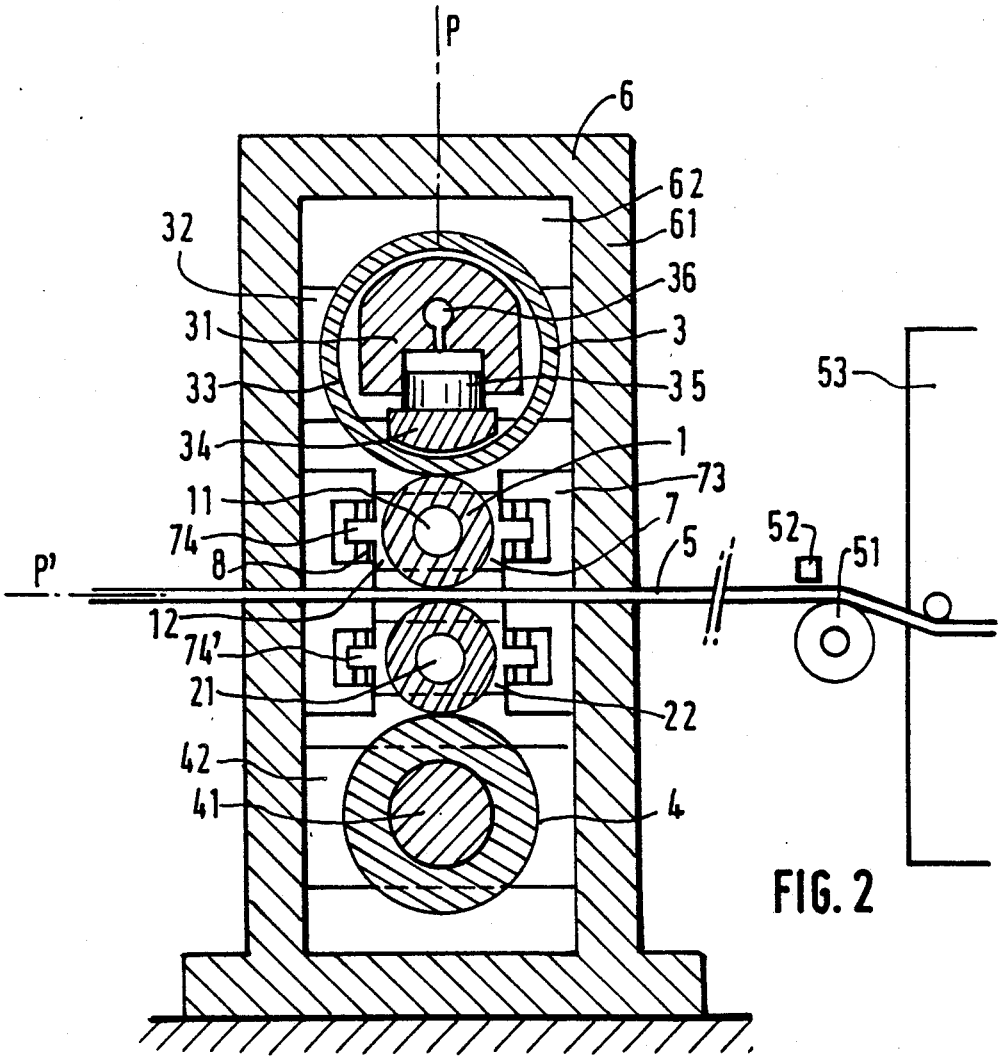
FIG. 2 is a schematic view of the rolling mill in section through a plane transverse to the axes of the rolls.

FIGS. 1 and 2 show schematically a rolling mill of the four-up type which comprises an assembly of four superposed rolls having parallel axes and disposed in a vertical pressure application plane P, namely, two work rolls 1 and 2 enclosed between a top backup roll 3 and a bottom backup roll 4, a product 5 in band form passing between said work rolls. The whole arrangement is disposed in conventional manner inside a rolling mill stand 6 comprising two vertical columns 61. As can be seen in FIG. 1, each roll 1, 2, 3, 4 is mounted for rotation about a respective shaft 11, 21, 31, 41, the ends of which shafts are carried by support means 12, 22, 32, 42 housed in windows 62 formed in the two columns 61 of the stand 6.

These arrangements are well known and do not require any particular explanation. The pressure load is generally applied by screws or jacks 63 to the two ends of the shaft 31 of the top backup roll 3 and is taken by the bottom backup roll 4, whose shaft 41 bears directly on the stand 6 at its two ends, the product 5 thus being gripped between the two work rolls 1 and 2 along generatrices of contact 13, 23, each of which defines a line of support.

It will be realized that, if the rolls were perfectly rigid, the two lines of support 13 and 23 would be rectilinear and parallel, while the rolled product 5 would be perfectly plane and of constant thickness. However it is obviously not possible to avoid the bending of the various rolls by the loads applied, particularly as the width (L) of the product is shorter than the length (L) of the backup rolls, and as in consequence the product exerts a reaction on the work rolls only in the central portion of the latter while the ends remain free and can therefore move towards one another, thereby entailing the thinning of the edges of the product.

Furthermore, since the pressure load is applied to the two ends of the shaft 31 of the backup roll 3 and since the coacting roll 4 taking the load bears on the stand through the ends of its shaft 41, the shafts tend to bend in the manner shown exaggeratedly in FIG. 1, which in the case of a solid roll entails a corresponding deformation of the casing of the roll.

In order to compensate for this inevitable sagging of the shaft, in an arrangement which is already well known the top backup roll 3 is a variable camber roll, more precisely one having a deformable casing. It has in fact a tubular cylindrical casing 33 mounted for rotation about the shaft 31 and also bearing against the latter by means of a series of support shoes 34, each associated with a thrust jack 35 fed by a hydraulic circuit which passes through a bore 36 provided along the shaft 31. The jacks 35 are preferably fed separately and at individually adjustable pressure, making it possible to adjust accurately the profile of the casing 33 and in particular the line of support 37 on the work roll 1. Installations of this kind are generally symmetrical, the two backup rolls having deformable casings. In contrast, in the installation according to the invention the bottom backup roll 4 is a solid roll, which consequently constitutes a simple coacting roll to take the pressure transmitted by the work roll 2.

Each work roll 1 or 2 is also composed of a solid roll of rather small diameter, mounted for rotation about a shaft whose ends 11, 21 are carried by bearings mounted in chocks 7 housed in corresponding windows 62 in the stand 6 and mounted for sliding movement in the direction of the pressure application plane P passing through the axes of the rolls.

Figure 4:
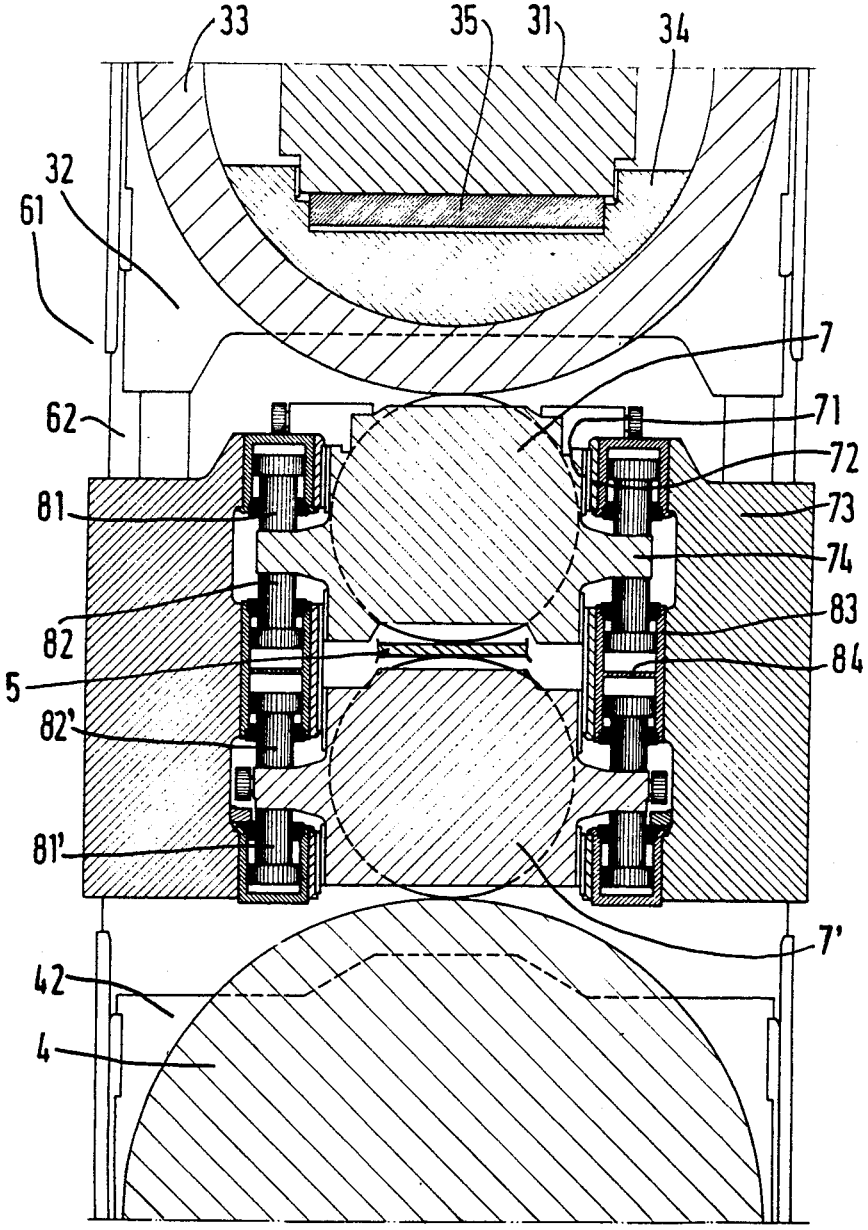
FIG. 4 is a detail view in cross-section of the cambering means.

For this purpose, as illustrated in detail in FIG. 4, each chock 7 is provided with vertical guide faces 71 sliding along slide guides 72 formed on support members 73 fixed on the columns 61 of the stand 6 and housing sets of hydraulic jacks 8 (FIG. 2) bearing in both directions against the chocks 7 for the adjustment of their position along the slide guides 72.

In a fairly conventional arrangement, each chock 7 is provided on each side of the plane of symmetry P with two lugs 74 associated with two pairs of jacks, namely top jacks 81 and bottom jacks 82, whose bodies are mounted in the support members 73 and whose rods bear in opposite directions against the two horizontal faces of the lugs 74. In this way, when one or the other of the two pairs of jacks 81 is placed under pressure, it is possible to displace each chock 7 for its respective movement away from or towards the horizontal plane P' of the passage of the product 5 between the rolls 1 and 2.

It will be realized that if each work roll 1 or 2 is allowed to sag freely through the action of the loads applied in one direction by the product 5 and in the other direction by the corresponding backup roll, the chocks 7 of said roll 1 (2) will assume inside the windows 62 in the stand a position of equilibrium which depends on the profile of the backup roll and on the distribution of the pressures on the product 5. On the other hand, by acting on one or the other of the pairs of jacks 81, 82 the work roll 1 (2) will be given a camber in one direction or the other, which modifies the profile of the line of support 13 (23) and consequently the distribution of the pressures over the product 5.

It is usually said that a positive camber is produced when the chocks 7 are moved away from the plane P' of the product 5 by increasing the pressure in the central portion of the product, and that a negative camber is obtained when the chocks 7 are moved towards the plane P' of the product 5 by increasing the pressure on the edges of the product.

In order to verify the regularity of the thickness and flatness of the band 5 after the rolling, it is possible to use various known means, for example a flatness measuring roller 51 disposed downstream of the stand 6, the band passing over said roller while subjected to a certain tension. Measuring instruments disposed along the roller 51 make it possible to detect variations over its width of the force applied by the band and to deduce therefrom the defects of flatness. Another measuring instrument 52 makes it possible to measure the thickness of the band and optionally to verify the regularity of the thickness over the width.

Various known systems exist for measuring the flatness and thickness of the rolled band; a measuring roller is described in detail, for example, in applicants' Patent FR 2.538.537.

FIG. 1 shows exaggeratedly the deformations of the rolls.

The pressure force is generally applied to the top backup roll 3, transmitted by the product 5, and absorbed by the bottom backup roll 4.

In view of the fact that loads are applied to the ends of the shafts 31 and 41 of the two backup rolls, the latter tend to sag, their axes assuming an incurved shape with their concavity facing the product. It is therefore natural to utilize a symmetrical stand comprising two variable camber backup rolls so that the deformation of the casing compensates for the bending of the shaft and each backup roll has a line of support as rectilinear as possible for the corresponding work roll.

In the installation according to the invention, on the other hand, use is made of an asymmetrical stand containing only one backup roll whose casing is deformable; this will normally be the top backup roll 3 to which the pressure loads are applied, while the bottom backup roll 4 is a simple solid roll which is allowed to sag freely under the action of the loads applied.

According to a first characteristic of the invention, instead of simply compensating for the sag of the shaft 31 of the top roll so that the line of contact 37 will be substantially rectilinear, the camber of the casing 33 will be still further increased so that the line of contact 37 will be convex in the direction of the product 5 and will preferably have a curvature substantially equal to that of the line of support 47 of the bottom roll 5 resulting from the free sagging of the latter.

Consequently, the two work rolls 1 and 2 likewise assume an incurved shape, the lines of support 13 and 23 being substantially parallel and concave in the upward direction.

This has the result that, instead of obtaining a product which is as flat as possible, it will on the contrary be accepted that the product 5 leaving the rolling mill will have an incurved shape. It is true that it is rather surprising to control the rolling process intentionally so as to obtain an incurved product, but this curvature of the product leaving the rolling mill actually does not entail any considerable disadvantage because it has been known for a long time how to correct such defects after rolling, using devices known as "anti-tiles".

On the other hand, the fact that the product has a curved transverse profile does not in any way hinder the correction of flatness and thickness defects, which can be done in particular by acting on the cambering loads applied to the two work rolls 1 and 2.

However, in arrangements known up to the present time it was the practice to act symmetrically on the two work rolls by moving their chocks apart for a positive camber or towards one another for a negative camber. In the process according to the invention, on the contrary, the two work rolls are acted on separately, one being give a positive camber and the other a negative camber for adaptation to the shape of the bottom backup roll. This has the consequence that the cambering system 8 is different from systems which were employed in the past and which bore in opposite directions against the chocks of the two work rolls.

Figure 3:
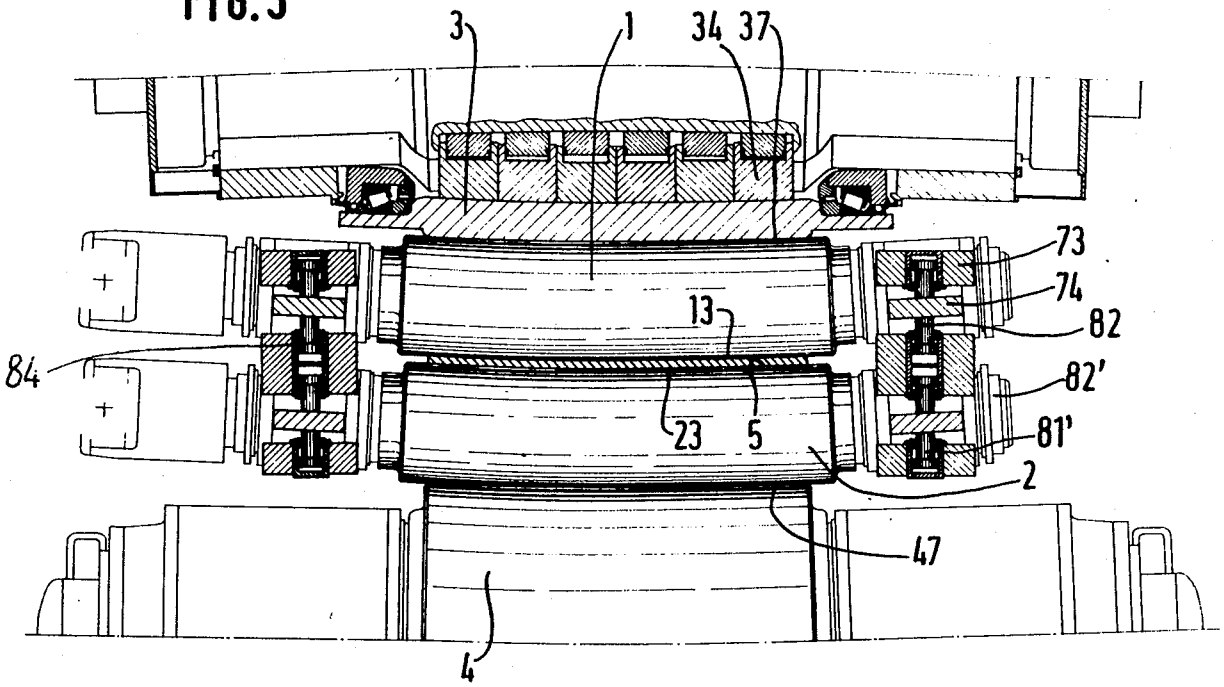
FIG. 3 is a front view of one particular embodiment.

The cambering system 8 is illustrated in detail in FIGS. 3 and 4. As can be seen, the sets of jacks 81, 82, 81', 82' acting respectively on the rolls 1 and 2 are mounted in the guide members 73 but are separate from one another. For technological reasons, the bodies of the positive camber jacks 82, 82' consist in fact of one and the same member 83 incorporated in the support member 73, but the chambers of the jacks are separated from one another by a partition 84 and are fed separately and at individually adjustable pressures, thus making it possible for the two jacks 82, 82' positioning the chocks 7, 7' to be adjusted independently of one another, each jack bearing directly on the column 61 of the rolling mill by way of the support member 73.

As the result of these arrangements, it is possible on the one hand to adjust the profile of the line of support 37 of the top backup roll 3 in order to make it substantially parallel to the line of support 47 of the bottom roll 4, and on the other hand to control separately the camber of the work rolls 1 and 2 in such a manner as to obtain a product which is incurved but of constant thickness, while the regularity of the thickness can be corrected at any time in accordance with thickness and flatness measurements made downstream.

For the adjustment of the profile of the top backup roll and of the camber of the work rolls, it is possible to use different known regulation systems. A system of this kind is in particular described in detail in applicant's French Patent FR 83.16341.

The product 5 thus leaves the rolling mill in an incurved state and is straightened in a device 53 of the "anti-tile" type, which does not need a detailed description since such devices are well known.

An installation for carrying out the process is illustrated schematically by way of example in FIG. 1.

This figure shows symbolically the rolling mill stand 1 with its four rolls, the jacks 63 applying pressure, and the means 8 applying bending loads to the shafts 11, 21 of the work rolls 1,/and 2 and also means 51 and 52, shown in front of the stand 6, for verifying flatness and measuring thickness, respectively.

The actions of these different components are controlled and monitored by a regulation system 9 associated with a model 90, preferably a mathematical model.

The bending of the shaft 31 through the action of the pressure jacks 63 is measured by displacement transducers 38 disposed at its ends.

The pressures in the different jacks controlling the shoes 34 are determined individually by a hydraulic control unit 39.

Each cambering device 8 applying a bending load to one end of the shaft of a work roll 1 or 2 is associated with a transducer 75 supplying a signal representing the position of the corresponding chocks 7, and with a hydraulic unit 85 regulating the loads applied in one direction or the other by the sets of jacks 81 or 82.

These different measuring means transmit signals representing respectively the pressure load applied by the jacks 63, the deformation of the central shaft 31 of the top backup roll 3, the positive or negative camber of the work rolls 1 and 2, and the thickness of the sheet, these signals being transmitted to the different inputs 91, 92, 93, 94 of the regulation system 9.

The mathematical model 90, in which have been entered all the structural and dimensional characteristics of the stand and of the rolls, as well as those of the rolled product, determines, in dependence on the pressure load applied by the jacks 63 and on the characteristics of the product, the profile of the line of support 47 of the bottom roll 4 and the pressures to be applied to the shoes 34 by means of the hydraulic control means 39, to ensure that the line of support 37 of the top roll 3 will have a convex shape facing the band, with the same curvature as the line of support 47, by means of the regulation process described in the above-mentioned French patent.

In the same way it is possible to determine the positions of equilibrium, i.e., positions without cambering load, of the chocks 7 of the two work rolls 1 and 2 corresponding to this curvature of the lines of support 37 and 47 of the backup rolls 3 and 4. In addition, the flatness defects detected by the monitoring device 51 during operation are also converted into signals which are applied to an input 95 of the regulation system 9 which, with the aid of the hydraulic unit 39, determines the loads which must be applied by the different support shoes 34 to correct accordingly the profile of the line of support 37. By referring to the information contained in the mathematical model 90, the regulation system 9 then determines the profile of the lines of support 13 and 23 of the two backup rolls as the result of the different loads applied over the width of the sheet. This may be achieved in different ways, for example by digital or analog methods on a screen 96 associated with the regulation system 9. It is thus possible to detect a defect of parallelism between the lines of support 13 and 23 of the two work rolls 1 and 2, which would result in a variation of the thickness of the product over its width, and to make individually the corrections required for the different cambering devices 8 acting separately on the ends of the shafts of the two work rolls. These corrections may be made manually by an operator, or automatically, by comparison of the shape of the lines of support 13 and 23 determined by the mathematical model 90, or of the variation of their spacing over the length of the two rolls. Individual control of the cambering loads applied to each end of each work roll will in fact make it possible to monitor in optimum manner the shapes of the lines of support in order to compensate for any irregularity of the thickness of the roll pass 50.

The invention may be adapted to other regulation systems.

For example, in the embodiment described the camber of the rolls is adjusted by acting on the position of the chocks, but a bending force may also be applied directly to each end of each roll.

Moreover, the invention has been described in its preferential application to a four-high rolling mill, but it may be applied to other types of rolling mills, for example of the six-high type with intermediate rolls provided with cambering means, or to rolling mills comprising three rolls. The product then passes between the work roll and a coacting roll corresponding to the bottom backup roll, said coacting roll being allowed according to the invention to deform freely under the load applied and the top backup roll being of the deformable casing, adjustable profile type, the cambering loads being applied to the single work roll in order to correct irregularities of thickness.

Similarly, in the embodiment described above use was made of a backup roll having a rotating casing supported by shoes, this arrangement making it possible to obtain particularly accurate adjustment of the profile of the generatrix of support, but it would be possible to apply the invention by utilizing other means of adjusting the profile of the backup roll, particularly through the inflation of the casing.

We claim:

1. Process for the rolling of a metal product in a rolling mill comprising a stand (6) having two columns (61);

at least four rolls (1, 2, 3, 4) mounted inside said stand for rotation about parallel axes which are disposed in a pressure application plane (P), each on a shaft (11, 21, 31, 41) carried at its two ends respectively by support means (12, 22, 32, 42);

said rolls comprising two work rolls (1, 2) delimiting an elongate space (50) for passage of said product (5), a variable camber backup roll (3) which cooperates with a first (1) of said work rolls and a coacting roll (4) which cooperates with a second (2) of said work rolls;

at least the support means (11, 12) of said work rolls (1, 2) being each constituted by a chock (7) sliding along the corresponding columns (61) of said stand (6);

said variable camber backup roll (3) having a deformable cylindrical casing (33) which is mounted on a central shaft (31) and whose profile (37) can be adjusted by the application of thrust loads between said central shaft (31) and an inner face of said casing (33);

means (63) for applying a pressure load to ends of said shaft (31) of said backup roll (3);

means for cambering said two work rolls (1, 2) by applying bending loads to ends of the shaft of each said work roll;

said means (8) for cambering comprising positive and negative hydraulic camber devices (81, 82) respectively cooperating with each said chock (70 of each said work roll (1, 2), said hydraulic camber devices (81, 82) being supplied separately at individually adjustable pressure for positioning said chocks (7) independently of one another;

said process comprising the steps of (a) allowing said coacting roll (4) to deform freely under the action of the pressure load to form a line of support (47) which is concave in the direction of said product (5);

(b) adjusting the profile of said deformable casing (33) of said backup roll (3) in such a manner as to form a line of support (37) which is convex in the direction of said product (5) and is substantially parallel to the line of support (47) of said coacting roll (4);

(c) individually adjusting the camber of each said work roll (1, 2) in such a manner as to maintain a constant thickness of the roll pass over the entire width of said product (5);

(d) producing at an exit of said rolling mill a product (5) having an incurved transverse profile with a constant thickness; and (e) straightening said incurved product (5) to obtain a flat product.

2. Rolling process as claimed in claim 1, wherein the camber of said work rolls (1, 2) is adjusted by applying to the ends of their shafts bending loads whose direction and intensity are adjustable individually for each end of each roll bearing directly against the corresponding column of said stand.

3. Rolling process as claimed in claim 2, wherein, when the camber of said two work rolls (1, 2) is effected by the application of thrust loads in either direction to the support means (12, 22) of their shafts, the position of each support means (12, 22) of each said work roll (1, 2) is adjusted separately relative to an equilibrium position so as to maintain said constant thickness of said roll pass (50).

4. Rolling process as claimed in any one of claims 1 to 3, wherein the adjustment of the external profile of said backup roll (3) and of the camber of each said work roll (1, 2) is effected automatically by reference to a model (90), taking into account dimensional and resistance characteristics of different components and products (5) and adapted to determine corrections to be made to said profile (37) of said deformable casing (33) and to the position of each support means (12, 22) of said work rolls, based on measurements of thickness and flatness made on the band downstream of said rolling mill, in such a manner as to maintain a constant thickness of said space (50) for passage of said product (5) over the entire width of said product.

5. Rolling process as claimed in claim 4, wherein the line of support (13, 23) of each work roll (1, 2) on the product has a shape determined on the basis of measurements made downstream and in dependence on loads applied, corrections to be made to the profile of said backup roll (3) and to the camber of said work rolls (1, 2) being determined by comparison of the profiles of their lines of support (13, 23) in order to keep said lines parallel to one another and spaced a constant distance apart corresponding to the thickness to be given to said product (5).

6. Process for the rolling of a metal product in band form by passage through a rolling mill comprising, inside a stand (6), at least three rolls (1, 3, 4) having parallel axes and disposed in a pressure application plane (P), each being mounted for rotation about a shaft (11, 31, 41) carried at each end by a support means (12, 32, 42) housed in a column (61) of the stand (6), namely, a work roll (1) and a coacting roll (4) forming between them an elongate space (5) for the passage of the band (5), and at least one variable camber backup roll (3) comprising a cylindrical casing (33) which is mounted on a central shaft (31) and whose profile can be adjusted by the application of thrust loads between the central shaft (31) and the inner face of the casing (33), means (63) for applying a pressure load to the ends of the shaft (31) of the backup roll (3) and means (8) for applying bending loads to the ends of the shaft (11) of the work roll (1) for the adjustment of the camber of said roll, said process comprising the steps of (a) allowing the coacting roll (4) to deform freely under the action of the pressure load to form a line of support (47) which is concave in the direction of the rolling pass (50);

(b) controlling the deformation of said casing (33) of said variable camber backup roll (3) in such a manner as to form a line of support (37) which is convex in the direction of said roll pass (50) and substantially parallel to said line of support (47) of said coacting roll (4); and (c) adjusting the camber of the work roll (1) in such a manner as to maintain a constant thickness of said roll pass over the entire width of said product (5), said product on leaving said rolling mill having an incurved transverse profile capable of being subsequently corrected.

7. Apparatus for rolling a product in band form, having a support stand (6) comprising two spaced columns (61), at least four rolls (1, 2, 3, 4) having parallel axes and superposed along a pressure application plane, each of said rolls being mounted for rotation about a shaft (11, 21, 31, 41) carried at its two ends by support means (12, 22, 32, 42) housed in said columns (61) of said stand (6), said rolls including two work rolls (1, 2) forming between them an elongate space (50) for passage of said product (5), each of said work rolls bearing, on a side remote from said space (50), against a respective backup roll (3, 4), one of said backup rolls being of the variable camber type having a cylindrical casing (33) mounted on a central shaft (31), and means for adjusting the profile of said casing (33) by applying thrust loads between said central shaft (31) and an inner wall of said casing (33), means (63) for applying a pressure load to ends of said shaft (31) of said backup roll (3), and means (8) for cambering said two work rolls (1, 2) by applying bending loads to ends of their shafts (11, 21), the other backup roll (4) being a simple solid coacting roll supported on said stand (6) and adapted to sag freely under the action of the pressure load to form a concave line of support (47) for the corresponding work roll (2), and the work roll cambering means comprising separate means (81, 82) (81', 82') for applying a bending load to each end of the shaft (11, 21) of each said work roll (1, 2), said cambering means being supported separately on said stand and being adjusted individually.

8. Rolling apparatus according to claim 7, wherein the support means (12, 11) of said work rolls consists of chocks (7) mounted for sliding movement along corresponding columns (61) of said stand (6), and the cambering means (8) consist of hydraulic jacks (81, 82) adjusting the positioning of said chocks and being associated in groups independent of one another and corresponding respectively to each chock (7) of each work roll (1, 2), each group of jacks bearing directly on the corresponding column (61) of said stand (6) and being associated with a separate control means (75, 85) for individual adjustment of the positioning of each chock (7).

9. Rolling apparatus according to claim 8, wherein said separate control means (75, 85) of each said group of cambering jacks are associated with a device (9) for automatic regulation by reference to a mathematical model (90) established in accordance with dimensional and resistance characteristics of different components of said rolling mill and of said rolled product (5) and adapted to determine, on the basis of thickness and flatness measurements made on said product (5) at an outlet of said stand (6) and in dependence on the loads applied, corrections to be made to the external profile (37) of said variable camber backup roll (3) and to the position of each chock (7) in relation to its equilibrium position, in such a manner as to maintain a constant thickness of said space (50) between said work rolls (1, 2) over their entire length.

* * * * *